US009646583B2

(12) United States Patent
Bailey

(10) Patent No.: US 9,646,583 B2
(45) Date of Patent: May 9, 2017

(54) REMOTE HI-HAT MOUTH CONTROLLER

(71) Applicant: Kevin Henry Bailey, Raleigh, NC (US)

(72) Inventor: Kevin Henry Bailey, Raleigh, NC (US)

( * ) Notice: Subject to any disclaimer, the term of this patent is extended or adjusted under 35 U.S.C. 154(b) by 0 days.

(21) Appl. No.: 15/157,743

(22) Filed: May 18, 2016

(65) Prior Publication Data

US 2016/0343360 A1 Nov. 24, 2016

Related U.S. Application Data

(60) Provisional application No. 62/163,315, filed on May 18, 2015.

(51) Int. Cl.

| | |
|---|---|
| ***G10D 13/02*** | (2006.01) |
| ***G10D 13/06*** | (2006.01) |
| ***G10H 1/00*** | (2006.01) |

(52) U.S. Cl.

CPC ..... *G10D 13/065* (2013.01); *G10D 13/024* (2013.01); *G10H 1/0083* (2013.01); *G10H 2220/361* (2013.01); *G10H 2230/331* (2013.01)

(58) Field of Classification Search

CPC ..... G10D 13/065

See application file for complete search history.

(56) References Cited

U.S. PATENT DOCUMENTS 1,045,357 A * 11/1912 Anderson ..... G10D 13/006 84/246
3,967,523 A * 7/1976 Currier ..... G10D 13/006 84/422.1
4,747,333 A * 5/1988 Hoshino ..... G10D 13/006 84/422.1
4,929,826 A * 5/1990 Truchsess ..... G10H 1/0553 250/215
5,212,476 A * 5/1993 Maloney ..... A61B 5/04886 340/4.11
5,267,500 A * 12/1993 Lombardi ..... G10D 13/065 84/402
5,438,903 A * 8/1995 Cropek ..... G10D 13/065 84/422.3
5,453,567 A * 9/1995 Brinson ..... G10F 1/08 84/104
5,523,745 A * 6/1996 Fortune ..... A61F 4/00 340/4.12
5,689,246 A * 11/1997 Dordick ..... H01H 3/14 340/4.11
5,789,688 A * 8/1998 Schiano ..... G10D 13/065 84/422.1
6,201,173 B1 * 3/2001 Black ..... G10D 13/006 84/104
6,222,524 B1 * 4/2001 Salem ..... A61F 4/00 340/4.11
6,598,006 B1 * 7/2003 Honda ..... A61F 4/00 340/4.11
7,071,844 B1 * 7/2006 Moise ..... G06F 3/03547 340/4.11

(Continued)

*Primary Examiner* — Robert W Horn
(74) *Attorney, Agent, or Firm* — K&L Gates LLP

(57) ABSTRACT

A wireless hi-hat cymbal controller is activated by a user's biting action. The controller includes a pressure sensor located in a mouthpiece and operably coupled to a wireless transceiver. An actuator operates in response to a wireless signal received from the controller when the pressure sensor detects that a user is biting down on the mouthpiece.

18 Claims, 10 Drawing Sheets

(56) References Cited

U.S. PATENT DOCUMENTS

| | | | | |
|---|---|---|---|---|
| 7,091,875 | B2 * | 8/2006 | Ondracek | A61F 4/00 340/12.55 |
| 7,351,902 | B1 * | 4/2008 | Sikra | G10D 13/065 84/422.1 |
| 7,608,771 | B2 * | 10/2009 | Fournier | G10D 13/006 84/104 |
| 7,768,499 | B2 * | 8/2010 | Sturtz | G06F 3/011 341/20 |
| 7,995,031 | B2 * | 8/2011 | Manal | G06F 3/01 345/156 |
| 8,389,848 | B1 * | 3/2013 | Baker | G10H 1/348 84/612 |
| 9,117,363 | B2 * | 8/2015 | Kimmel | G08C 17/02 |
| 2004/0164881 | A1 * | 8/2004 | Loun Mok | G06F 3/011 341/20 |
| 2005/0150355 | A1 * | 7/2005 | Sutej | G10D 13/065 84/422.3 |
| 2008/0131106 | A1 * | 6/2008 | Bruce | G03B 17/08 396/25 |
| 2016/0343360 | A1 * | 11/2016 | Bailey | G10D 13/065 |

* cited by examiner

REMOTE HI-HAT MOUTH CONTROLLER

CROSS-REFERENCE TO RELATED APPLICATIONS

This patent application is a non-provisional patent application filed under 35 U.S.C. §111(a) and claims priority under 35 U.S.C. §119(e) to U.S. Provisional Patent Application No. 62/163,315, filed on May 18, 2015. U.S. Provisional Patent Application No. 62/163,315 is incorporated by reference into this specification.

BACKGROUND

The information described in this background section is not admitted to be prior art.

A hi-hat is a percussion cymbal and stand assembly commonly incorporated in drum kits with other components such as a bass drum, floor torn, snare drum, hanging toms, crash cymbal, ride cymbal, splash cymbal, China cymbal, and the like. A hi-hat is comprised of two cymbals horizontally mounted on a vertical stand. The two cymbals are mounted on top of each other, in a spaced relationship, with the top cymbal mounted bell up, and the bottom cymbal mounted bell down. The stand is generally comprised of a vertically extending support tube and a mounting rod that extends through the center of the support tube. The bottom cymbal is mounted toward the top end of the support tube, and the top cymbal is mounted toward the top end of the mounting rod. The mounting rod is biased in an upward position relative to the support tube by a spring located in the center of the support tube and operably connected to the support tube and the mounting rod.

The bottom end of the mounting rod of the vertical stand of a hi-hat assembly is connected to a foot pedal at the bottom end of the support tube. When the pedal is pressed by a drummer or other operator, the mounting rod is pulled downward against the biasing force provided by the spring, which drives the top cymbal downward toward the bottom cymbal. The pedal is used to cause the top cymbal to strike the bottom cymbal and to hold the top cymbal in engagement with the bottom cymbal. When the pedal is released, the spring forces the mounting rod upward, which disengages the cymbals and moves the top cymbal upward and away from the bottom cymbal. The magnitude of the force holding the top and bottom cymbals together can be varied by varying the pressure applied to the pedal by a drummer or other operator.

The foot-actuated operation of a hi-hat assembly places limitations on the drummer or other operator. For example, a drummer cannot simultaneously operate a double bass drum pedal and a hi-hat pedal. Additionally, a disabled drummer who has an impaired or no ability to use his or her legs and/or feet cannot operate a hi-hat assembly. Accordingly, it would be beneficial to provide a modified hi-hat assembly that can be operated with a mechanism that does not require foot-actuation of a pedal.

SUMMARY

This specification generally relates to the control and operation of hi-hat cymbal stands. More specifically, this specification relates to systems, devices, and methods for controlling and operating a hi-hat assembly that do not require the foot-actuation of a pedal.

In one example, a mouthpiece controller device for a hi-hat assembly comprises a mouthpiece, a pressure sensor located in the mouthpiece, and a wireless transceiver operably coupled to the pressure sensor. The pressure sensor is configured to be activated by biting action when the mouthpiece is placed in a user's mouth. The wireless transceiver is configured to transmit a signal to when the pressure sensor detects that a user is biting down on the mouthpiece.

In another example, hi-hat assembly comprises a support tube, a bottom cymbal attached to the support tube, a mounting rod extended through the support tube, a top cymbal attached to the mounting rod, and a mechanical transducer device. The mechanical transducer device comprises an actuator operably connected to the mounting rod, and a wireless transceiver operably coupled to the actuator. The actuator applies a force that pulls the mounting rod downward, moving the top cymbal toward the bottom cymbal, in response to a wireless signal received from a controller. The controller may comprise a mouthpiece, a pressure sensor located in the mouthpiece, and a first wireless transceiver operably coupled to the pressure sensor. The controller sends the wireless signal when the pressure sensor detects that a user is biting down on the mouthpiece.

In another example, a system for controlling hi-hat cymbals comprises a controller configured to be activated by biting action when placed in a user's mouth. The controller comprises a mouthpiece, a pressure sensor located in the mouthpiece, and a first wireless transceiver operably coupled to the pressure sensor. The system may also comprise a mechanical transducer device. The optional mechanical transducer device comprises an actuator configured to operably connect to a hi-hat assembly, and a second wireless transceiver operably coupled to the actuator. The actuator operates in response to a wireless signal received from the controller when the pressure sensor detects that a user is biting down on the mouthpiece.

It is understood that the invention described in this specification is not necessarily limited to the examples summarized in this Summary.

BRIEF DESCRIPTION OF THE DRAWINGS

Various features and characteristics of the invention described in this specification may be better understood by reference to the accompanying figures, in which.

The reader will appreciate the foregoing features and characteristics, as well as others, upon considering the following detailed description of the invention according to this specification.

DESCRIPTION

Figure 1A:
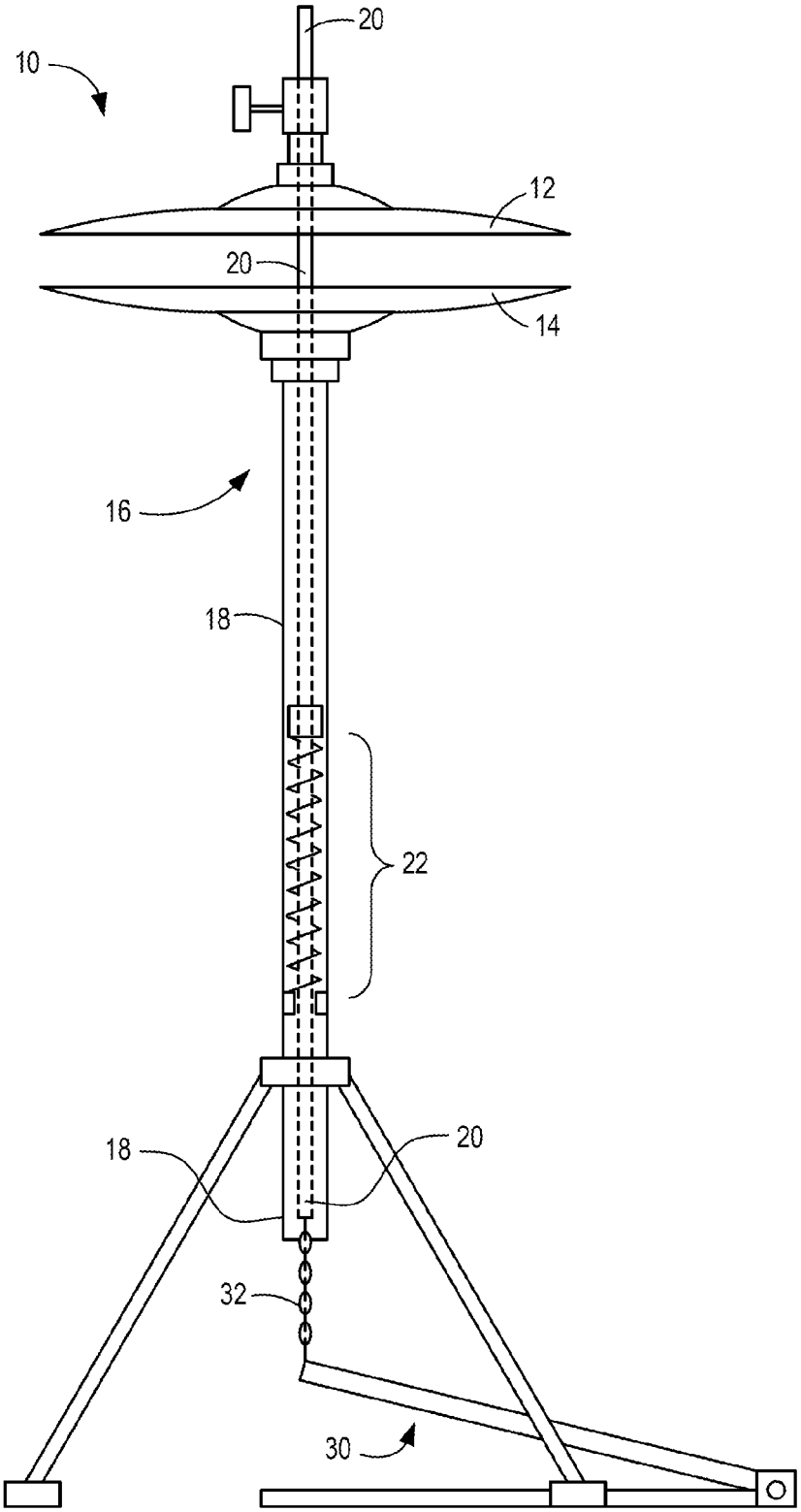
FIG. 1A is a side view schematic diagram of an open hi-hat assembly operably connected to a foot pedal to actuate the closing of the hi-hat assembly.
Figure 1B:
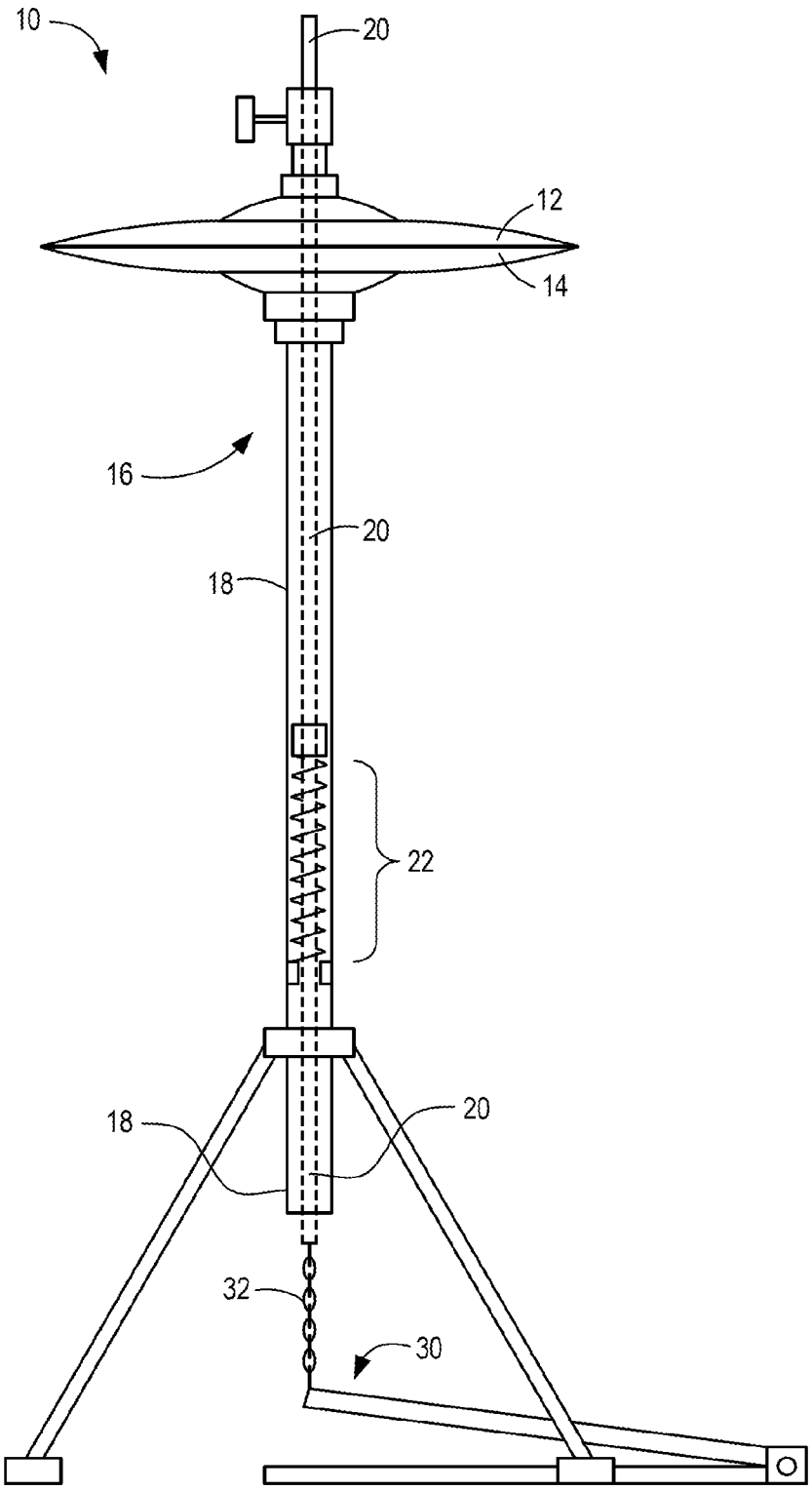
FIG. 1B is a side view schematic diagram of the closed hi-hat assembly as shown.

Referring to FIGS. 1A and 1B, a hi-hat assembly 10 comprises cymbals 12 and 14 horizontally mounted on a vertical stand 16. The two cymbals 12 and 14 are mounted on top of each other, in a spaced relationship, with the top cymbal 12 mounted bell up, and the bottom cymbal 14 mounted bell down. The stand 16 comprises a vertically extending support tube 18 and a mounting rod 20 that extends through the center of the support tube 18. The bottom cymbal 14 is mounted toward the top end of the support tube 18, and the top cymbal 12 is mounted toward the top end of the mounting rod 20. The mounting rod 20 is biased in an upward position relative to the support tube 18 by a spring 22 located in the center of the support tube 18 and operably connected to the support tube 18 and the mounting rod 20.

The bottom end of the mounting rod 20 of the vertical stand 16 of the hi-hat assembly 10 is connected to a foot pedal 30 at the bottom end of the support tube 18. The mounting rod 20 is connected to the foot pedal 30 with a chain 32. When the pedal 30 is pressed by a drummer or other operator, the mounting rod 20 is pulled downward by the chain 32, against the upward biasing force provided by the spring 22, which drives the top cymbal 12 downward toward the bottom cymbal 14. The pedal 30 is used to cause the top cymbal 12 to strike the bottom cymbal 14 and to hold the top cymbal 12 in engagement with the bottom cymbal 14, as shown in FIG. 2B. When the pedal 30 is released, the spring 22 forces the mounting rod 20 upward, which disengages the cymbals 12 and 14 and moves the top cymbal 12 upward and away from the bottom cymbal 14. The magnitude of the force holding the top and bottom cymbals 12 and 14 together can be varied by varying the pressure applied to the pedal 30 by a drummer or other operator—i.e., the harder a drummer presses down on the pedal 30, the tighter the hi-hat cymbals 12 and 14 are held together, and when the drummer takes their foot off of the pedal 30, the cymbals 12 and 14 move apart and remain apart until the pedal is pressed again.

The construction and operation of a hi-hat assembly is described in greater detail in U.S. Patent Application Publication No. 2006/0169124 A1, which is incorporated by reference into this specification. As noted above, the foot-actuated operation of a hi-hat assembly, such as the hi-hat assembly 10 shown in FIGS. 1A and 1B, places limitations on the drummer or other operator. For example, if the hi-hat assembly 10 is incorporated into a drum kit with a double base drum, a drummer cannot simultaneously operate the double bass drum pedals and the foot pedal 30. Additionally, a disabled drummer who has an impaired or no ability to use his or her legs and/or feet cannot operate a hi-hat assembly, such as the hi-hat assembly 10 shown in FIGS. 1A and 1B. Accordingly, it would be beneficial to provide a modified hi-hat assembly that can be operated with a mechanism that does not require foot-actuation of a pedal.

The present invention modifies hi-hat assemblies by replacing the hi-hat pedal with a wirelessly-controlled, motor-driven device that actuates the mounting rod, and thus replaces the need for drummers to use their feet to operate the hi-hat cymbals. The present invention allows a drummer to fully control the hi-hat cymbals by biting down on a mouthpiece controller comprising an embedded pressure sensor. The pressure sensor sends a signal when depressed by a user's bite to a wireless transceiver, which transmits a wireless signal to another transceiver located in a mechanical transducer device or an electronic drum kit. The transceiver in the mechanical transducer device sends the received signal to a microcontroller in the mechanical transducer device, which controls the operation of an actuator in response to the received signal. The actuator is operably connected to the mounting rod of a hi-hat assembly, thus pulling the mounting rod downward, against the upward biasing force provided by the spring of the hi-hat assembly, and driving the top cymbal downward toward the bottom cymbal.

The present invention can be used with an acoustic drum set or an electronic drum set, and will allow a drummer to remotely control the hi-hat cymbals with the mouthpiece controller device in the drummer's mouth, as opposed to the drummer using his foot to actuate a conventional hi-hat pedal. This allows the drummer to take the foot that was previously dedicated to the hi-hat pedal and use it for something else (like a double bass drum pedal) while still retaining the full functionality of the hi-hat cymbal assembly. Alternatively, it allows lower extremity disabled drummers to fully play the hi-hat cymbals.

Figure 2:
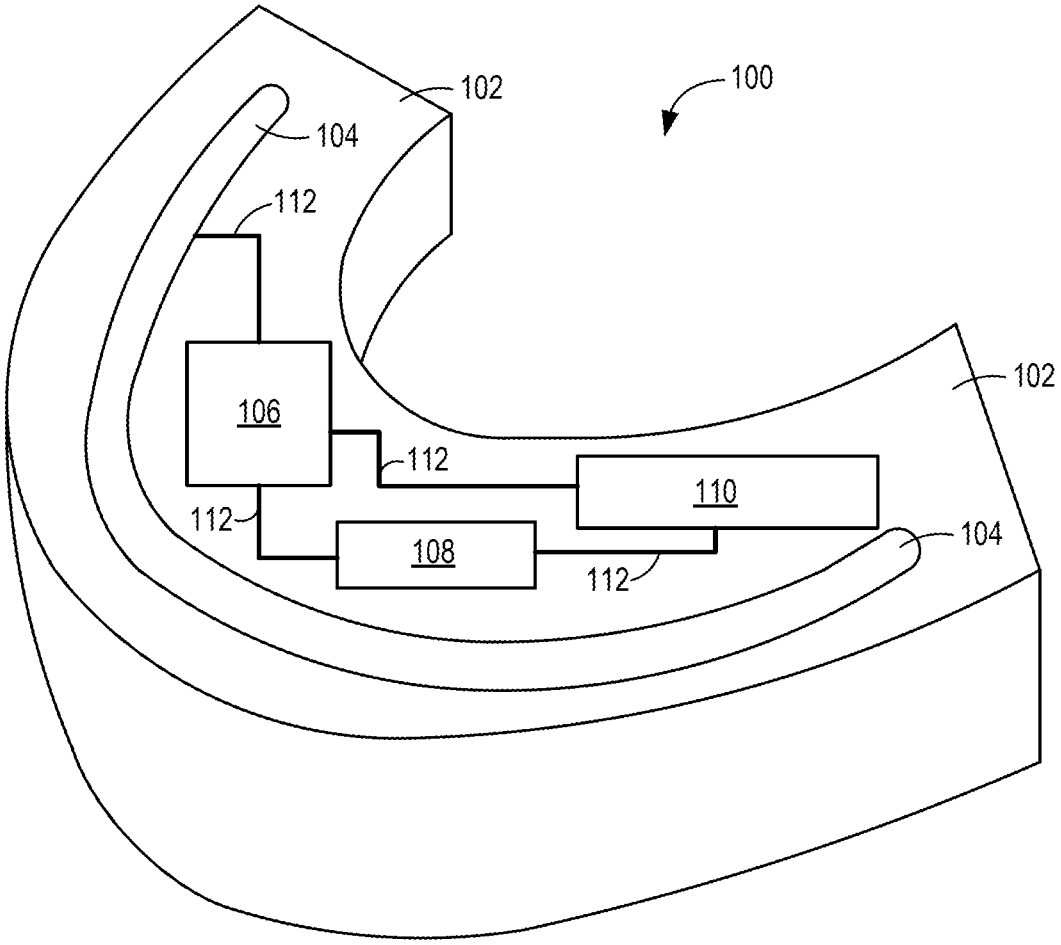
FIG. 2 is a perspective view schematic diagram of a mouth guard-shaped mouthpiece controller device configured to wirelessly control a motor or other mechanical transducer device operably connected to a hi-hat assembly to actuate the closing of the hi-hat assembly.

Referring to FIG. 2, a controller 100 is configured to be activated by biting action when placed in a user's mouth. The controller 100 comprises a mouthpiece 102 and a pressure sensor 104 located in the mouthpiece 102. A microcontroller 106, a power source 108, and a wireless transceiver 110 are operably coupled to the pressure sensor 104. As shown in FIG. 2, the microcontroller 106, the power source 108, and the wireless transceiver 110 are embedded within the mouthpiece 102 and are operably coupled to the pressure sensor 104 through interconnecting wires 112.

Figure 3:
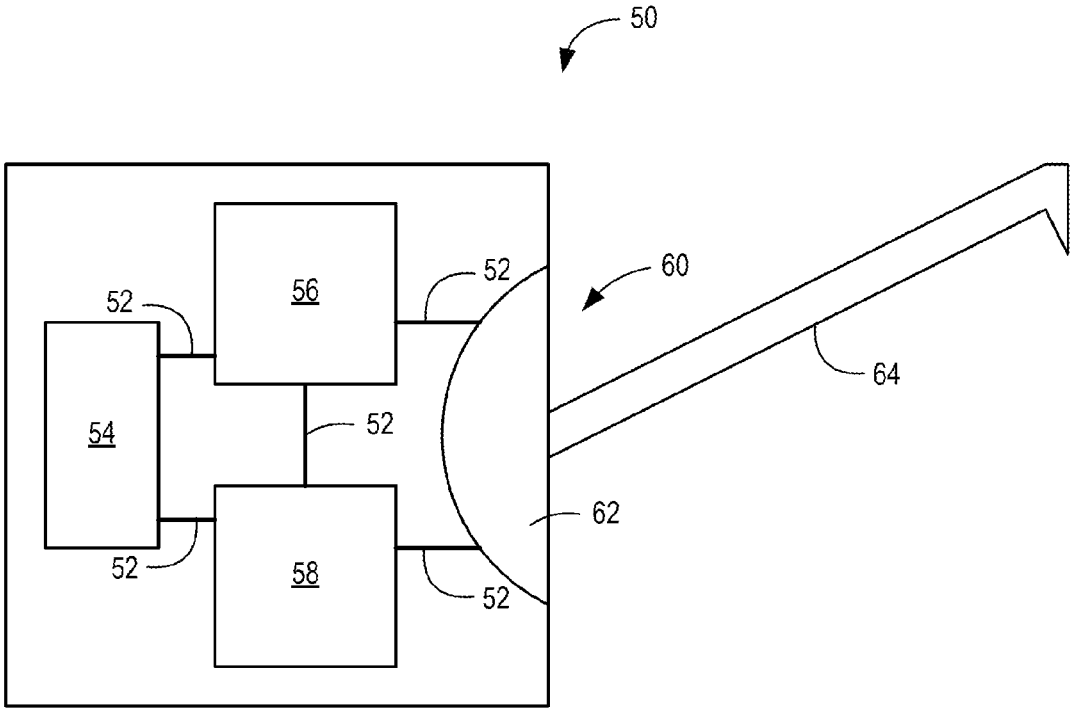
FIG. 3 is a side view schematic diagram of a motor or other mechanical transducer device that operably connects to and actuates the closing of a hi-hat assembly when wirelessly controlled with a mouthpiece controller device.

Referring to FIG. 3, a mechanical transducer device 50 comprises an actuator 60 configured to operably connect to a hi-hat assembly. The actuator 60 comprises a mechanical transducer 62 and an actuator arm 64, which can operably connect to the mounting rod of a hi-hat assembly through a chain, for example (see FIGS. 8A and 8B, described below). The mechanical transducer device 50 also comprises a microcontroller 56, a power source 58, and a wireless transceiver 54. The microcontroller 56, the power source 58, and the wireless transceiver 54 are operably coupled to the actuator 60 through wires 52. The actuator 60 operates in response to a wireless signal received through the wireless transceiver 54 from the wireless transceiver 110 in the controller 100 when the pressure sensor 104 detects that a user is biting down on the mouthpiece 102.

In various embodiments, the actuator 60 may comprise a motor-driven arm. In such embodiments, the motor corresponds to the mechanical transducer 62 and the arm corresponds to the actuator arm 64. In other embodiments, the actuator may comprise a linear solenoid actuator configured to advance and retract a bolt that can be operably coupled to the mounting rod of a hi-hat assembly (for example, using a chain or other driving linkage). In such embodiments, the solenoid coil corresponds to the mechanical transducer 62 and the bolt corresponds to the actuator arm 64.

Referring to FIGS. 2 and 3, in various embodiments, the invention comprises a system having two main components: 1) the mouthpiece controller device 100; and 2) the mechanical transducer device 50. The mouthpiece controller device 100 is used to send a signal to the mechanical transducer device 50 that causes the actuator 60 to mechanically move hi-hat cymbals closer together when operably connected to a hi-hat assembly (see FIGS. 8A and 8B). When describing the common components of the mouthpiece controller device 100 and the mechanical transducer device 50, the components of the mouthpiece controller device 100 can be referred to as the "first" components, and the components of the mechanical transducer device 50 can be referred to as the "second" components (e.g., the first microcontroller 106, the first wireless transceiver 110, the first power source 108, the second microcontroller 56, the second wireless transceiver 54, the second power source 58)

In various embodiments, the mouthpiece controller device is configured to perform at least two functions. First, the mouthpiece controller device is configured to detect pressure applied to it while in a drummer's mouth. This pressure is applied by the drummer biting down on the mouthpiece controller device. Second, the mouthpiece controller device is configured to wirelessly transmit a corresponding signal to operate the mechanical transducer device.

FIG. 2 shows that the mouthpiece controller device 100 is made up of the following components: the mouthpiece 102; the pressure sensor(s) 104, the microcontroller 106, the wireless transceiver 110; and the power source 108. These components can be arranged in any configuration and/or connected together in any way that allows for the mouthpiece controller device 100 to operably function. For example, FIGS. 2 and 4-7 show the pressure sensor connected to the microcontroller through a separate wire, and the microcontroller and the wireless transceiver each connected to the power source via separate wires. These illustrations are meant only to show how the pressure sensor, microcontroller, wireless transceiver, and power source may be connected together. These illustrations do not necessarily depict the only way that the pressure sensor, the microcontroller, the wireless transceiver, and the power source may be connected together.

The mouthpiece controller device is used inside a drummer's mouth and, therefore, the mouthpiece can be shaped in a complementary fashion. For example, the mouthpiece can be shaped like a mouth guard such as one would find in athletic or dental applications (see FIGS. 2, 4, and 6). However, the shape of the mouthpiece is not necessarily limited to any specific shape. Rather, any mouthpiece shape allowing the mouthpiece controller device to be used in a user's mouth and activated with a biting motion will function. For example, FIGS. 5 and 7 illustrate an alternative embodiment in which the mouthpiece is shaped like a tube.

The pressure sensor(s) is encased inside or embedded within the mouthpiece. The pressure sensor(s) is activated by the drummer biting down on the mouthpiece with the pressure sensor(s) inside. When the drummer bites down on the mouthpiece, the pressure sensor(s) senses the downward pressure. The pressure sensor(s) relay a signal to a first microcontroller to which the pressure sensor(s) is connected indicating the magnitude of the biting pressure. The first microcontroller takes the signal information received from the pressure sensor(s) and translates the signal into an appropriate wireless signal. The first microcontroller then passes the wireless signal to a first wireless transceiver to which the first microcontroller is connected. The first wireless transceiver transmits the wireless signal to the mechanical transducer device.

The mechanical transducer device is a second part of the present invention. The mechanical transducer device receives the signal transmitted from the mouthpiece controller device and actuates the mounting rod of an operably connected hi-hat assembly (for example, using a chain or other driving linkage) and thereby moves the hi-hat cymbals accordingly. The harder the drummer bites down on the mouthpiece controller device, the more force is actuated by the mechanical transducer device and the tighter the cymbals are held together. When the drummer is not biting down on the mouthpiece controller device, or when the drummer releases his bite on the mouthpiece controller device, the mechanical transducer device releases the applied force and the hi-hat cymbals move apart as a result of the biasing force provide by the spring component of the hi-hat assembly. The systems and devices of the present invention are configured to close the hi-hat cymbals to varying degrees, thus allowing for full functionality of the hi-hat cymbals.

Figure 8A:
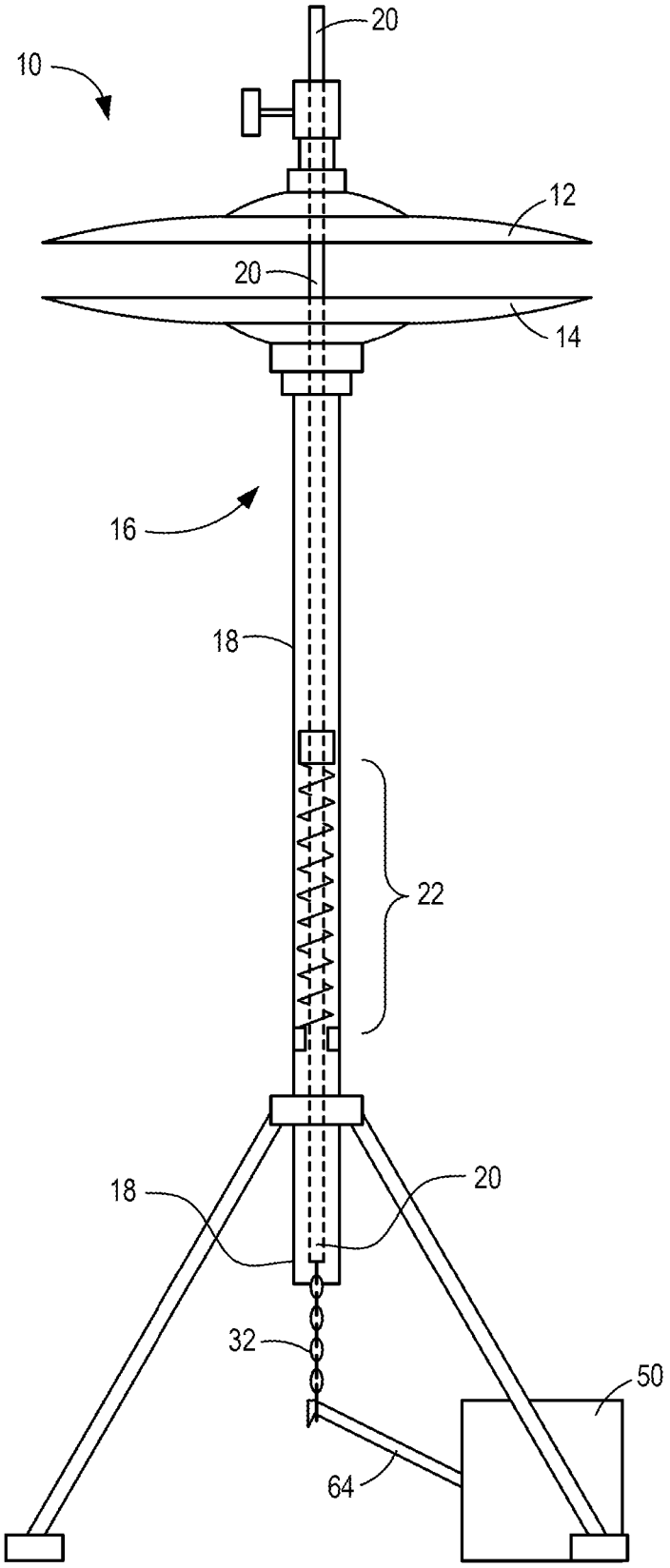
FIG. 8A is a side view schematic diagram of an open hi-hat assembly operably connected to a motor or other mechanical transducer device that actuates the closing of the hi-hat assembly when wirelessly controlled with a mouthpiece controller device.
Figure 8B:
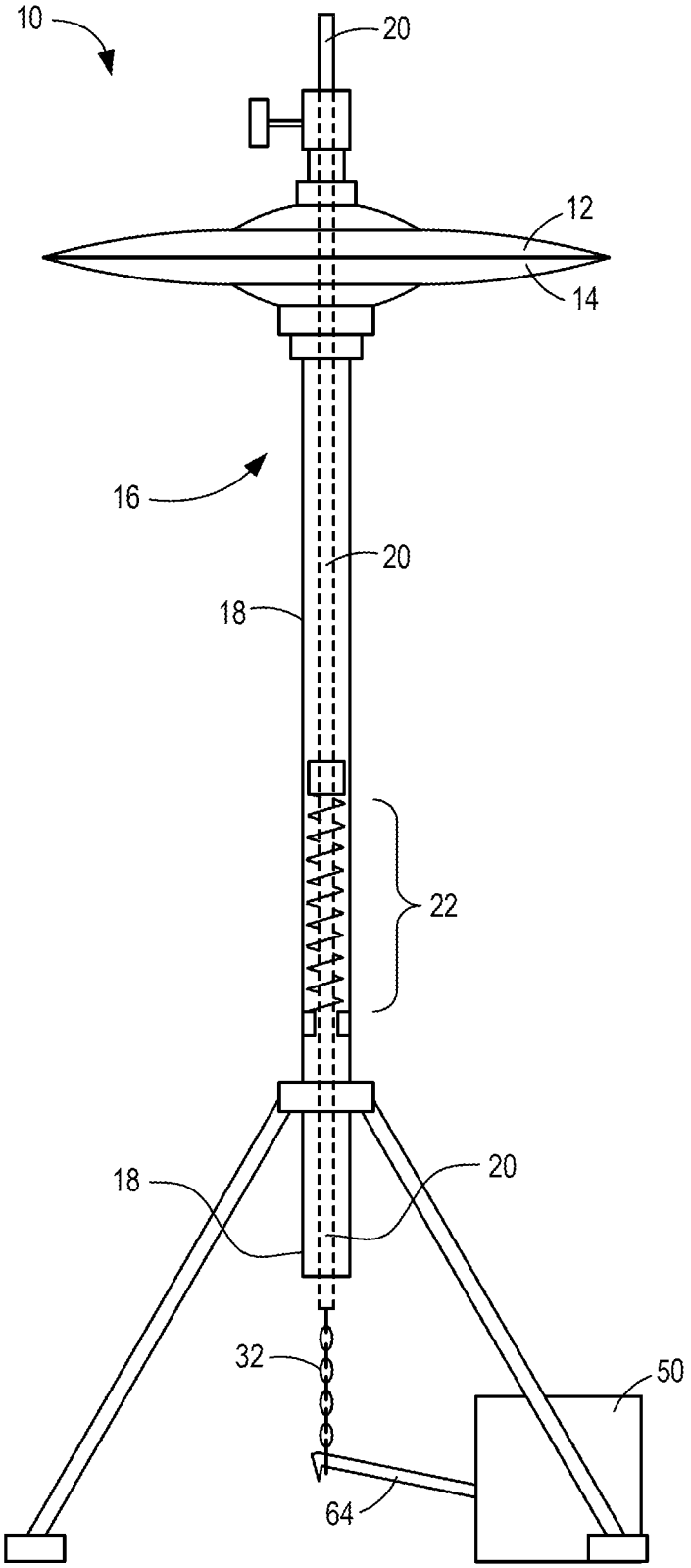
FIG. 8B is a side view schematic diagram of the closed hi-hat assembly.

The mechanical transducer device can be attached to a conventional hi-hat pedal or otherwise operably connected to the mounting rod of a hi-hat assembly, thereby replacing the pedal altogether (as shown in FIGS. 8A and 8B).

The mechanical transducer device can be attached via the actuator arm to an appropriate part of the hi-hat pedal or stand assembly. The appropriate parts of the hi-hat pedal or stand assembly to which the motor arm can be attached include—but are not necessarily limited to—the hi-hat foot pedal, the cymbal mounting rod, or the drive linkage (for example, a chain) which connects the hi-hat foot pedal to the cymbal mounting rod.

In various embodiments, the mechanical transducer device is configured to perform at least two functions. First, the mechanical transducer device is configured to receive the wireless signal from the mouthpiece controller device. Second, the mechanical transducer device moves the hi-hat cymbals according to the signal received.

FIG. 3 shows that the mechanical transducer device comprises the following components: the second wireless transceiver 54, the second microcontroller 56, the second power source 58, and the actuator 60 (comprising the mechanical transducer 62 (e.g., a motor or solenoid) and the actuator arm 64 (e.g., a motor arm or solenoid bolt). These components can be arranged in any configuration and/or connected together in any manner that allows the mechanical transducer device to operably function. For example, FIG. 3 shows the actuator 60 and the second wireless transceiver 54 each connected to the second microcontroller 56 and the second power source 58 via separate wires. These illustrations are meant only to illustrate how the second wireless transceiver 54, the second microcontroller 56, the actuator 60, and the second power source 58 may be connected together. These illustrations do not necessarily depict the only way that the second wireless transceiver 54, the second microcontroller 56, the actuator 60, and the second power source 58 may be connected together.

When the second wireless transceiver 54 receives a wireless signal from the mouthpiece controller device 100, the signal is relayed to the second microcontroller 56. The second microcontroller 56 takes the information received from the second wireless transceiver 54 and translates this message into an appropriate signal that is sent to the actuator 60. The actuator 60 (comprising, for example, a motor 62 and a motor arm 64) turns the actuator arm that is operably connected to an appropriate part of the hi-hat pedal or stand assembly.

FIGS. 3, 8A, and 8B depict an actuator that moves an actuator arm in an angular (rotational) fashion. While this type of motor and movement is appropriate, it does not preclude the substitution of other types of motors or planes of movement for the motor arm or the use of a linear solenoid and bolt device, for example.

In various embodiments, the mouthpiece controller device may be used in connection with an electronic drum set, but instead of sending a signal to a mechanical transducer device, it will send a signal to the main module of the electronic drum set. In such embodiments, there is no need for a mechanical transducer device. Instead, the mouthpiece controller device acts as a mini-pedal so that when the drummer bites the mouthpiece, it signals the electronic drum set that the hi-hat sound should be "closed" (cymbals together). And when the drummer is not biting down on the mouthpiece or when the drummer releases his bite on the mouthpiece, it signals the electronic drum set that the hi-hat sound should be "open" (cymbals apart). In this manner, the present invention is configured to control the simulation all of the sounds of a normal, non-adapted electronic hi-hat equipped with a pedal.

Figure 4:
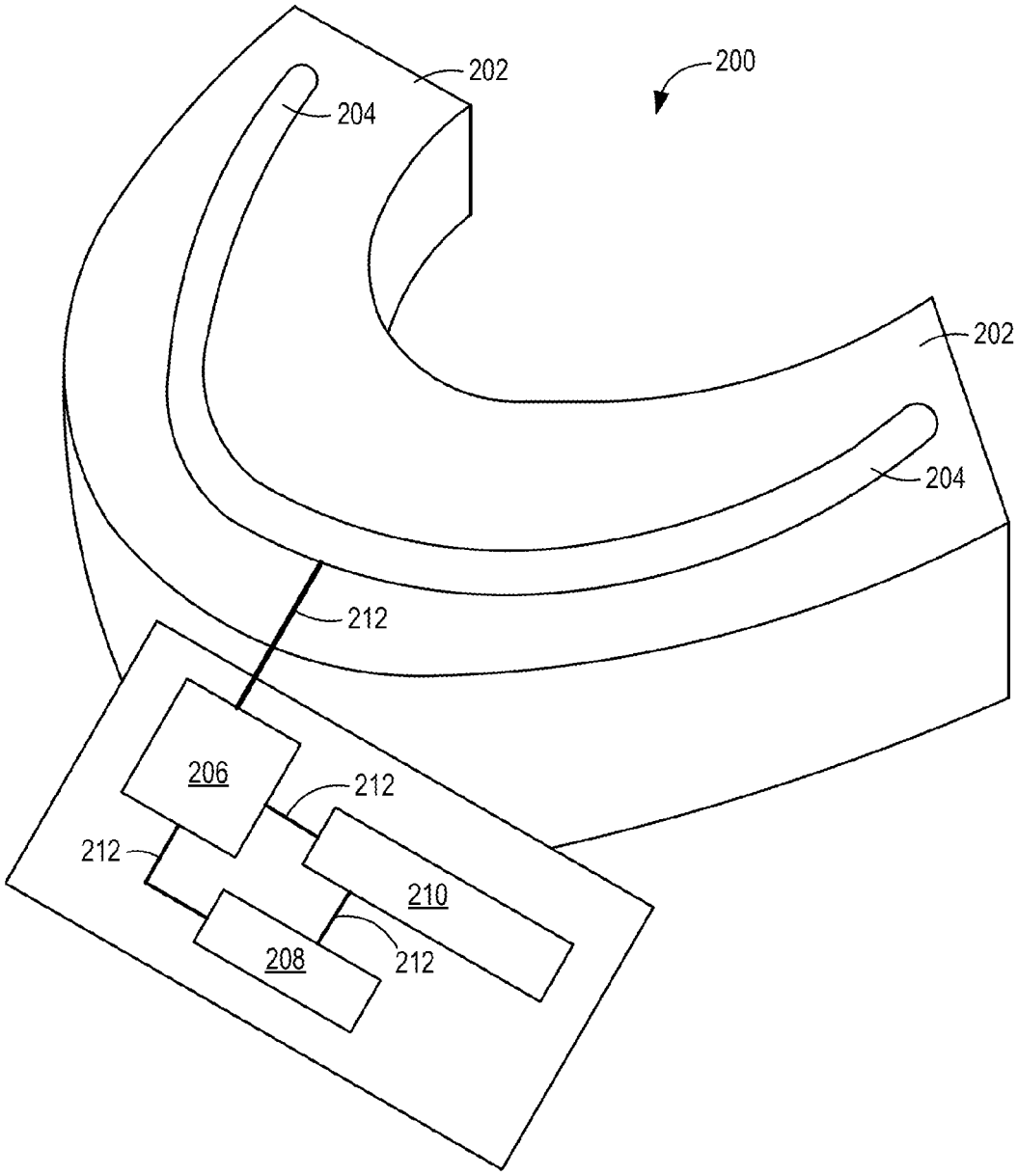
FIG. 4 is a perspective view schematic diagram of a mouth guard-shaped mouthpiece controller device configured to wirelessly control a motor or other mechanical transducer device operably connected to a hi-hat assembly to actuate the closing of the hi-hat assembly.
Figure 5:
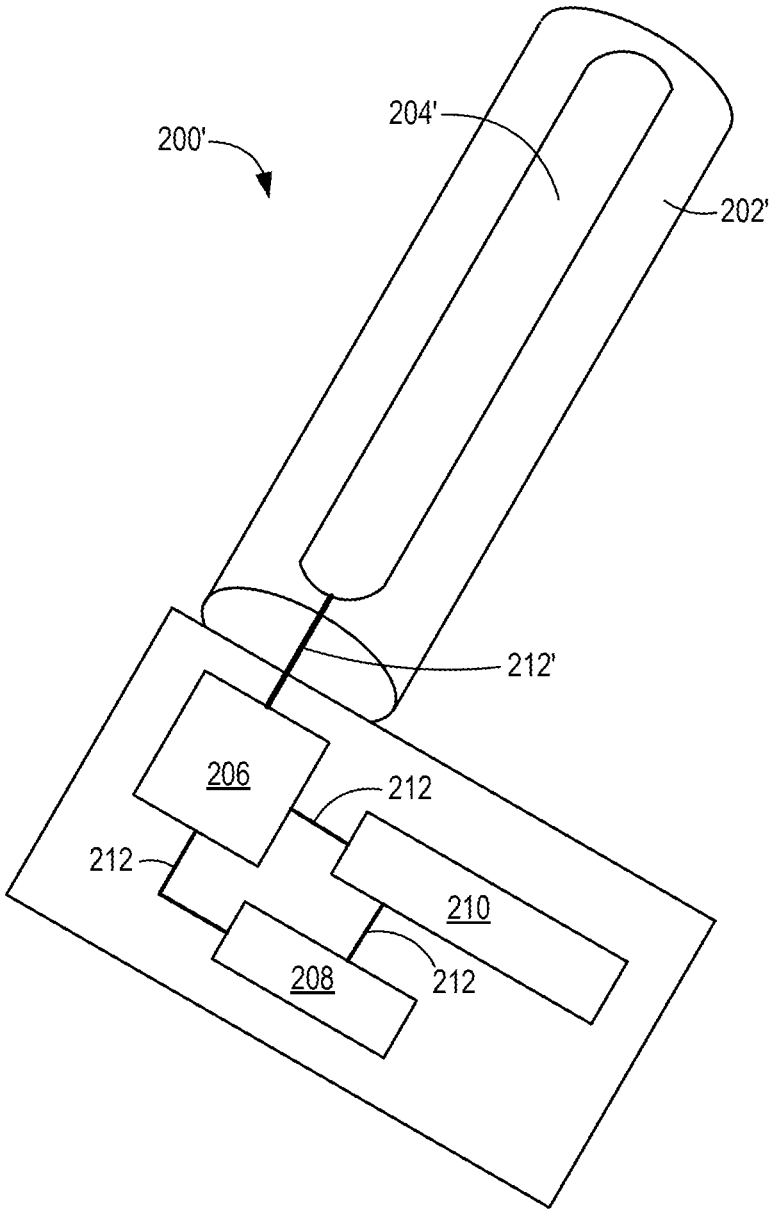
FIG. 5 is a perspective view schematic diagram of a tube-shaped mouthpiece controller device configured to wirelessly control a motor or other mechanical transducer device operably connected to a hi-hat assembly to actuate the closing of the hi-hat assembly.

An alternative embodiment of the mouthpiece controller device is shown in FIG. 4 in which the microcontroller, the first wireless transceiver, and the power source are located outside the mouthpiece. A controller 200 is configured to be activated by biting action when placed in a user's mouth. The controller 200 comprises a mouthpiece 202 and a pressure sensor 204 located in the mouthpiece 202. The first microcontroller 206, the first power source 208, and the first wireless transceiver 210 are operably coupled to the pressure sensor 204 through wires 212, but are located external to the body of the mouthpiece 202. As shown in FIG. 4, the first microcontroller 206, the first power source 208, and the first wireless transceiver 210 are located in an external casing that is not placed inside a user's mouth.

The body of the mouthpiece 202 of the controller 200 shown in FIG. 4 is mouth guard-shaped. Referring to FIG. 5, an alternative embodiment of the controller 200' comprises a pressure sensor 204' located in a tube-shaped mouthpiece 202'.

Figure 6:
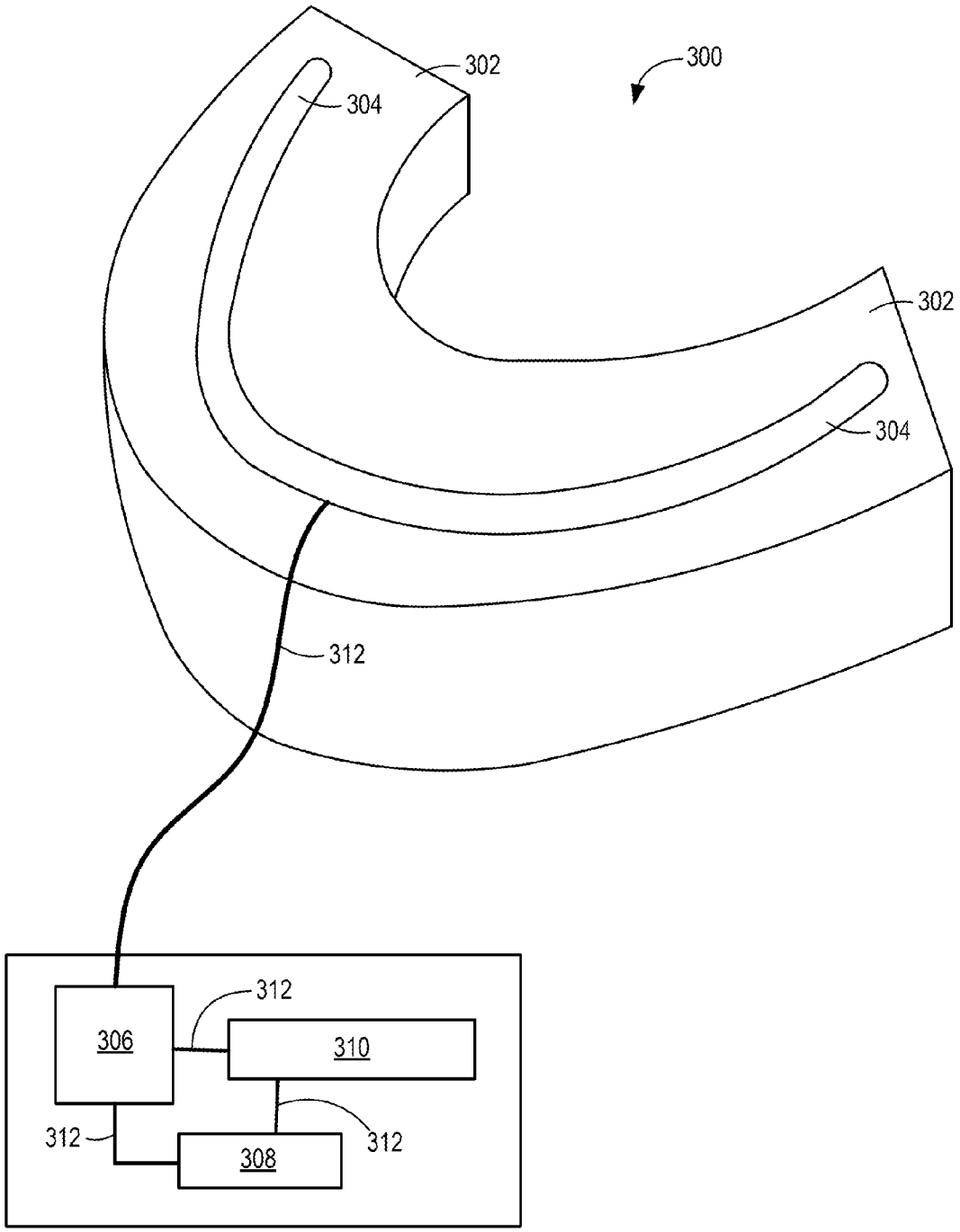
FIG. 6 is a perspective view schematic diagram of a mouth guard-shaped mouthpiece controller device configured to wirelessly control a motor or other mechanical transducer device operably connected to a hi-hat assembly to actuate the closing of the hi-hat assembly.
Figure 7:
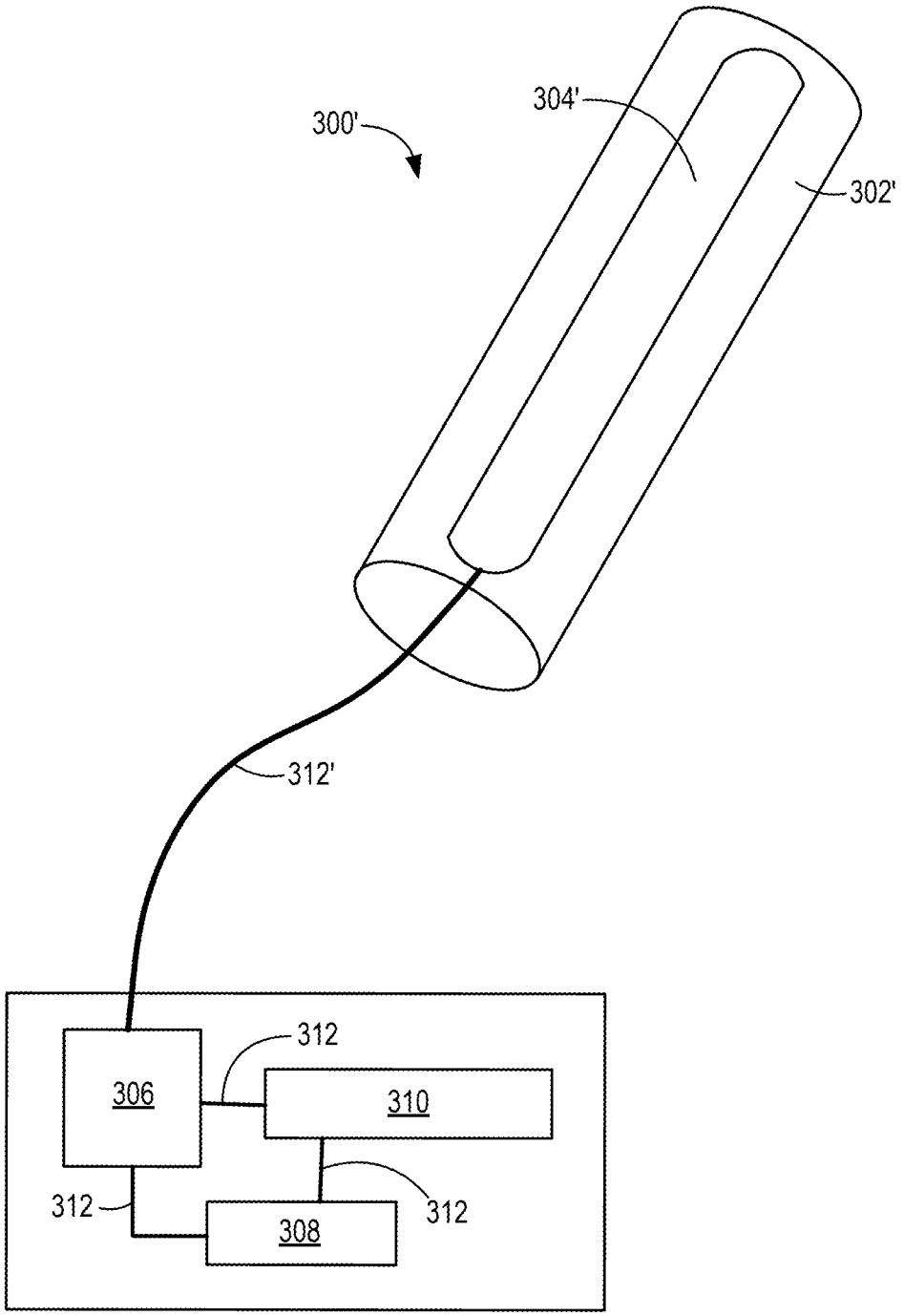
FIG. 7 is a perspective view schematic diagram of a tube-shaped mouthpiece controller device configured to wirelessly control a motor or other mechanical transducer device operably connected to a hi-hat assembly to actuate the closing of the hi-hat assembly.

Another alternative embodiment of the mouthpiece controller device is shown in FIG. 6 in which the microcontroller, the first wireless transceiver, and the power source are located farther outside the mouthpiece. A controller 300 is configured to be activated by biting action when placed in a user's mouth. The controller 300 comprises a mouthpiece 302 and a pressure sensor 304 located in the mouthpiece 302. The first microcontroller 306, the first power source 308, and the first wireless transceiver 310 are operably coupled to the pressure sensor 304 through wires 312, but are located external to the body of the mouthpiece 302. As shown in FIG. 6, the first microcontroller 306, the first power source 308, and the first wireless transceiver 310 are located in an external casing that is not placed inside a user's mouth, but which is connected to the pressure sensor 304 in the mouthpiece 302 via the wire 312.

The body of the mouthpiece 302 of the controller 300 shown in FIG. 6 is mouth guard-shaped. Referring to FIG. 7, an alternative embodiment of the controller 300' comprises a pressure sensor 304' located in a tube-shaped mouthpiece 302'.

The mouthpiece controller devices (100, 200, 200', 300, and 300') shown in FIGS. 2 and 4-7 are all operable with the mechanical transducer device 50 shown in FIG. 3. Referring to FIGS. 8A and 8B, the mechanical transducer device 50 is shown operably connected to a hi-hat assembly 10 comprising cymbals 12 and 14 horizontally mounted on a vertical stand 16 comprising a vertically extending support tube 18 and a mounting rod 20 that extends through the center of the support tube 18. The actuator arm 64 of the mechanical transducer device 50 is connected to the cymbal mounting rod 20 of the hi-hat assembly 10 via a chain 32 (other suitable attachments are described above).

When a user bites down on the mouthpiece controller device, the actuator arm 64 pulls the chain 32 downward, which pulls the mounting rod 20 downward against the upward biasing force provided by the spring 22, which drives the top cymbal 12 downward toward the bottom cymbal 14. The mouthpiece controller device is used to cause the top cymbal 12 to strike the bottom cymbal 14 and to hold the top cymbal 12 in engagement with the bottom cymbal 14, as shown in FIG. 8A. When the biting force is released from the mouthpiece controller device, mechanical transducer device 50 releases the force through the actuator arm 64 and the spring 22 forces the mounting rod 20 upward, which disengages the cymbals 12 and 14 and moves the top cymbal 12 upward and away from the bottom cymbal 14. The magnitude of the force holding the top and bottom cymbals 12 and 14 together can be varied by varying the bite pressure applied to the mouthpiece controller device by a drummer or other operator—i.e., the harder a drummer bites down on the mouthpiece controller device, the tighter the hi-hat cymbals 12 and 14 are held together, and when the drummer releases their bite on the mouthpiece controller device, the cymbals 12 and 14 move apart and remain apart until the mouthpiece controller device is bit again.

The systems, devices, and methods described in this specification may comprise any suitable wireless transceiver devices, including, for example, devices utilizing a Bluetooth system operating in accordance with the Bluetooth Special Interest Group (SIG) series of protocols, including Bluetooth Specification versions v1.0, v1.1, v1.2, v1.0, v2.0 with Enhanced Data Rate (EDR), as well as one or more Bluetooth Profiles, and so forth. Other examples may include systems using infrared wireless techniques or near-field communication techniques and protocols, such as electromagnetic induction (EMI) techniques. These and other wireless communications standards are understood by one of ordinary skill in the art. Likewise, the systems, devices, and methods described in this specification may comprise any suitable microcontroller hardware. Additionally, the systems, devices, and methods described in this specification may comprise any suitable power sources, such as, for example, rechargeable or non-rechargeable batteries, and alternating current-based power sources such as plug-in hardware for electrical wall outlet usage.

In this specification, including the claims, spatial terms (e.g., top, bottom, vertical, horizontal, above, below, over, under, and the like) used to describe the relative orientation, location, or positioning of various components are not to be construed as limited to any specific frame of reference.

Various features and characteristics of the invention are described in this specification and illustrated in the drawings to provide an overall understanding of the disclosed systems, devices, and methods. It is understood that the various features and characteristics described in this specification and illustrated in the drawings can be combined in any suitable manner regardless of whether such features and characteristics are expressly described or illustrated in combination in this specification. The Inventor and the Applicant expressly intend such combinations of features and characteristics to be included within the scope of this specification. As such, the claims can be amended to recite, in any combination, any features and characteristics expressly or inherently described in, or otherwise expressly or inherently supported by, this specification. Furthermore, the Applicant reserves the right to amend the claims to affirmatively disclaim features and characteristics that may be present in the prior art, even if those features and characteristics are not expressly described in this specification. Therefore, any such amendments will not add new matter to the specification or claims, and will comply with written description and new matter requirements under 35 U.S.C. §§112(a) and 132(a). The devices, assemblies, and systems described in this specification can comprise, consist of, or consist essentially of the various features and characteristics described in this specification.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and can be employed or used in an implementation of the described processes, compositions, and products. Further, the use of a singular noun includes the plural, and the use of a plural noun includes the singular, unless the context of the usage requires otherwise.

What is claimed is:

1. A system for controlling hi-hat cymbals comprising:
- a controller configured to be activated by biting action when placed in a user's mouth, the controller comprising:
  - a mouthpiece;
  - a pressure sensor located in the mouthpiece; and
  - a first wireless transceiver operably coupled to the pressure sensor; and
- a mechanical transducer device comprising:
  - an actuator configured to operably connect to a hi-hat assembly; and
  - a second wireless transceiver operably coupled to the actuator;
- wherein the actuator operates in response to a wireless signal received from the controller when the pressure sensor detects that a user is biting down on the mouthpiece; and
- wherein the actuator applies a force proportional to a bite force applied to the mouthpiece.

2. The system of claim 1, wherein the mouthpiece comprises a mouth guard shape.

3. The system of claim 1, wherein the mouthpiece comprises a tube shape.

4. The system of claim 1, wherein the mouthpiece further comprises a first microcontroller and a first power source, wherein the first microcontroller, the first power source, and the first wireless transceiver are operably coupled to the pressure sensor.

5. The system of claim 1, wherein the actuator comprises a mechanical transducer connected to an actuator arm.

6. The system of claim 5, wherein the mechanical transducer comprises a motor connected to the actuator arm.

7. The system of claim 1, wherein the actuator comprises a solenoid and bolt device.

8. The system of claim 1, wherein the mechanical transducer further comprises a second microcontroller and a second power source, wherein the second microcontroller, the second power source, and the second wireless transceiver are operably coupled to the actuator.

9. A hi-hat assembly comprising:
- a support tube;
- a bottom cymbal attached to the support tube;
- a mounting rod extended through the support tube;
- a top cymbal attached to the mounting rod; and
- a mechanical transducer device comprising:
  - an actuator operably connected to the mounting rod; and
  - a wireless transceiver operably coupled to the actuator;
- wherein the actuator applies a force that pulls the mounting rod downward, moving the top cymbal toward the bottom cymbal, in response to a wireless signal received from a controller comprising:
  - a mouthpiece;
  - a pressure sensor located in the mouthpiece; and
  - a first wireless transceiver operably coupled to the pressure sensor;
- wherein the controller sends the wireless signal when the pressure sensor detects that a user is biting down on the mouthpiece; and
- wherein the actuator applies a force proportional to a bite force applied to the mouthpiece.

10. The assembly of claim 9, wherein the actuator comprises a mechanical transducer connected to an actuator arm.

11. The assembly of claim 10, wherein the mechanical transducer comprises a motor connected to the actuator arm.

12. The assembly of claim 10, wherein the actuator arm is operably connected to the mounting rod through a chain.

13. The assembly of claim 10, wherein the actuator arm is operably connected to the mounting rod through a hi-hat pedal.

14. The assembly of claim 9, wherein the actuator comprises a solenoid and bolt device.

15. A system for controlling a hi-hat assembly, the system comprising:
- a bite-actuated controller comprising:
  - a mouthpiece;
  - a pressure sensor located in the mouthpiece; and
  - a wireless transceiver operably coupled to the pressure sensor;
  - wherein the pressure sensor is configured to be activated by biting action when the mouthpiece is placed in a user's mouth; and
  - wherein the wireless transceiver is configured to transmit a signal when the pressure sensor detects that a user is biting down on the mouthpiece; and
- a transducer device configured to operably connect to a hi-hat assembly and receive the signal transmitted from the wireless transceiver, wherein the transducer device comprises an actuator that applies a force proportional to a bite force applied to the mouthpiece.

16. The system of claim 15, wherein the mouthpiece comprises a mouth guard shape.

17. The system of claim 15, wherein the mouthpiece comprises a tube shape.

18. The system of claim 15, wherein the mouthpiece further comprises a first microcontroller and a first power source, wherein the first microcontroller, the first power source, and the first wireless transceiver are operably coupled to the pressure sensor.

* * * * *